US009696087B2

(12) United States Patent
Davidian et al.

(10) Patent No.: US 9,696,087 B2
(45) Date of Patent: Jul. 4, 2017

(54) METHOD AND APPARATUS FOR SEPARATING AIR BY CRYOGENIC DISTILLATION

(75) Inventors: Benoit Davidian, Saint maur des Fosses (FR); Richard Dubettier-Grenier, La Varenne Saint Hilaire (FR); Loïc Joly, Paris (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 581 days.

(21) Appl. No.: 14/110,356

(22) PCT Filed: Apr. 5, 2012

(86) PCT No.: PCT/FR2012/050742

§ 371 (c)(1),
(2), (4) Date: Oct. 8, 2013

(87) PCT Pub. No.: WO2012/136939

PCT Pub. Date: Oct. 11, 2012

(65) Prior Publication Data

US 2014/0053601 A1 Feb. 27, 2014

(30) Foreign Application Priority Data

Apr. 8, 2011 (FR) ..... 11 53070

(51) Int. Cl.
*F25J 3/04* (2006.01)

(52) U.S. Cl.
CPC ..... *F25J 3/04* (2013.01); *F25J 3/0406* (2013.01); *F25J 3/0409* (2013.01); *F25J 3/0486* (2013.01);

(Continued)

(58) Field of Classification Search
CPC .... F25J 3/0406; F25J 3/04206; F25J 3/04254; F25J 3/04351; F25J 3/4454;

(Continued)

(56) References Cited

U.S. PATENT DOCUMENTS 4,936,099 A 6/1990 Woodward et al.
5,546,767 A * 8/1996 Dray ..... F25J 3/04175 62/646

(Continued)

FOREIGN PATENT DOCUMENTS

EP 0547946 6/1993
EP 0793069 9/1997

(Continued)

OTHER PUBLICATIONS

WO 2009136075 A2 Translation.*
FR 1153070, French Search Report and Written Opinion, Feb. 1, 2012 (8 pp).

*Primary Examiner* — Frantz Jules
*Assistant Examiner* — Brian King
(74) *Attorney, Agent, or Firm* — Justin K. Murray

(57) ABSTRACT

A method for separating air is provided, in which a flow of oxygen-rich liquid is sent to a top of a pure oxygen column, having a pure oxygen reboiler, in which said flow is purified in order to form a vessel liquid containing at least 98 mol % of oxygen and the vessel liquid is drawn off as a product. A supercharged airflow at a second pressure is sent to the pure oxygen reboiler and to a liquid oxygen vaporizer; a nitrogen-rich gas is drawn from the top of the medium-pressure column and sent to an intermediate reboiler of the low-pressure column and the condensed gas is sent to the top of the medium-pressure column; and a nitrogen-rich gas or air is sent to a vessel reboiler of the low-pressure column and the liquid that condenses therein is sent to the medium-pressure column.

6 Claims, 3 Drawing Sheets

(52) U.S. Cl.
CPC ..... *F25J 3/04181* (2013.01); *F25J 3/04206* (2013.01); *F25J 3/04224* (2013.01); *F25J 3/04254* (2013.01); *F25J 3/04309* (2013.01); *F25J 3/04351* (2013.01); *F25J 3/04418* (2013.01); *F25J 3/04454* (2013.01); *F25J 2200/34* (2013.01); *F25J 2200/54* (2013.01); *F25J 2210/42* (2013.01); *F25J 2215/52* (2013.01); *F25J 2250/40* (2013.01); *F25J 2250/50* (2013.01)

(58) Field of Classification Search
CPC .. F25J 3/04181; F25J 3/04224; F25J 3/04309; F25J 3/04418; F25J 3/0486; F25J 3/0409; F25J 2200/32; F25J 2200/34; F25J 2215/52
See application file for complete search history.

(56) References Cited

U.S. PATENT DOCUMENTS 5,839,296 A 11/1998 Bonaquist et al.
5,916,262 A * 6/1999 Prosser ..... F25J 3/0409 62/646
6,155,078 A * 12/2000 Miyashita ..... F25J 3/04157 62/643

FOREIGN PATENT DOCUMENTS

FR 2787561 6/2000
WO WO 2009136075 A2 * 11/2009 ..... F25J 3/0406

* cited by examiner

METHOD AND APPARATUS FOR SEPARATING AIR BY CRYOGENIC DISTILLATION

CROSS REFERENCE TO RELATED APPLICATIONS

This application is a §371 of International PCT Application PCT/FR2012/050742, filed Apr. 5, 2012, which claims the benefit of FR1153070, filed Apr. 8, 2011, both of which are herein incorporated by reference in their entireties.

TECHNICAL FIELD OF THE INVENTION

This invention relates to a method and to an apparatus for separating air by cryogenic distillation.

The invention proposes in particular a method for producing pure oxygen using an air separation unit with a double vaporiser.

The method according to the invention allows for the production of pure liquid oxygen (containing at least 99 mol %, or even at least 99.6 mol % oxygen) on an apparatus producing impure gaseous oxygen (less than 97 mol %, or even than 96 mol %) at low pressure, for example in the scope of an apparatus for oxycombustion.

BACKGROUND

The drawings of air separation units (ASU) producing the oxygen intended for an oxy-coal power plant generally comprise two vaporisers (or even three) located between the medium-pressure column (MP column) and the low-pressure column (LP column). The installation of these two vaporisers makes it possible to reduce the pressure of the MP column to a value of about 3 bar absolute, which makes it possible to minimise the energy consumption of the ASU.

The purity of the oxygen produced by this type of power plant is typically between 95 and 97 mol % $O_2$. The vaporisation of the oxygen is performed in a dedicated vaporiser. The vaporisation frigories of the liquid oxygen are used to condense the gaseous air. A method of this type is known from U.S. Pat. No. 4,936,099 and EP-A-0547946.

Moreover, one can attempt to take advantage of the installation of such an ASU to produce pure liquid nitrogen and pure oxygen (purity of about 99.6%), stored and then intended for liquid trade via lorries.

The production of liquid nitrogen does not give rise to any major difficulty, as it is sufficient to add plates at the top of the MP column in order to achieve the desired purity, without impacting the rest of the ASU process, except for the cost of the liquefaction energy.

However, the production of pure oxygen (>99.6%) induces a more substantial impact on the method; indeed, the purity of the liquid produced is clearly superior to that of the gaseous oxygen supplied to the oxycombustion power plant. It is therefore necessary to install a small additional column, that recovers a fraction of the liquid flow collected in the LP column (in the vessel or on an intermediate plate), distilling same, which makes it possible to recover, at the bottom of this small additional column, the pure oxygen intended for trade by lorries. The gaseous return from the pure LOX column is then carried out at the same level as the tapping of the liquid in the LP column.

Nevertheless, the pressure of the MP column is so low that it is not possible to use one of the gaseous flows entering or exiting the MP column or the LP column to be condensed in the vessel vaporiser of the column of pure additional LOX (the condensation temperature thereof is too low).

SUMMARY OF THE INVENTION

In certain embodiment, the invention described herein proposes to use, as a condensing fluid, a fraction of the gaseous air exiting from the exchange line and which will subsequently enter into the dedicated exchanger providing the vaporisation of the production of pure oxygen (which is designated with the term HP air). This airflow is compressed upstream of the main exchange line by the main booster (BAC) of the unit.

The pressure of this flow is about 4.5 bar abs, higher than that of the MP column, and such that the bubble point thereof is higher than the equilibrium temperature of the pure liquid oxygen.

The difference in temperature between the airflow under consideration and the pure oxygen is about 2 to 3° C., a relatively high value, which makes it possible to install a small-size vaporiser.

In the invention, according to the alternative in FIG. 1, the production of pure liquid oxygen is free in terms of the separation energy and does not affect the separation energy for the production of the impure gaseous oxygen. Payment merely needs to be made for the liquefaction energy. The cold supply can be carried out by a liquefaction system that is independent of the ASU.

The invention proposes a method making it possible to produce pure oxygen (Purity>99.6%) on an air separation unit with a double vaporiser, typically used for oxycombustion, of which the majority of the oxygen is produced with a purity of about 95 to 97%.

Indeed, with this type of method, except for the HP air, there is no fluid available at a condensation temperature that is high enough to carry out the reboiling of the pure oxygen column.

Currently, there is no referenced solution for producing pure oxygen on an air separation unit with a double vaporiser.

For this purpose, a flow withdrawn at an intermediate level (and therefore at a higher temperature) in the main exchange line can be used, but this would complicate the method. This would also be less effective as it would entail using sensible heat against latent heat.

Air separation units (ASU) with a single vaporiser can be found frequently, where a small column producing ultra-pure oxygen is added to the vessel of the LP column. In this case, the pressure of the MP column is about 5 to 6 bar and the reboiling of the ultra pure LOX column is performed by a fraction of the gaseous airflow feeding the MP column.

EP-A-0793069 describes a method where air at a first pressure is used to vaporise oxygen in a vaporiser and air at a second pressure, higher than the first, is used for reboiling a pure oxygen column.

U.S. Pat. No. 5,916,262 describes a method for producing oxygen with two purities, using an oxygen purification column heated in a vessel by air. Liquid oxygen that has been pressurised by a pump is also vaporised in the main exchange line via heat exchange with boosted air.

This invention proposes to produce pure oxygen with a double vaporiser system by installing an additional pure oxygen column, of which the pressure is equal to the pressure of the LP column.

According to an object of the invention, a method is provided for separating air by cryogenic distillation in a separation unit comprising a medium-pressure column and a low-pressure column, connected thermally together, the low-pressure column comprising a vessel reboiler and an intermediate reboiler, and a pure oxygen column wherein i) purified and then cooled gaseous air at a first pressure is sent in an exchange line to the medium-pressure column, ii) an oxygen-rich liquid and a nitrogen-rich liquid are sent from the medium-pressure column to the low-pressure column, iii) a nitrogen-rich gas is withdrawn from the low-pressure column, iv) an oxygen-rich liquid is withdrawn containing at most 97 mol % oxygen in the vessel of the low-pressure column, v) a first flow of oxygen-rich liquid is sent to a vaporiser and the gaseous oxygen formed is sent to the exchange line, vi) a second flow of oxygen-rich liquid is sent to the top of the column of pure oxygen, having a vessel reboiler, where it is purified in order to form a vessel liquid containing at least 98 mol % oxygen, vii) a boosted airflow at a second pressure higher than the first pressure is sent to the vessel reboiler of the pure oxygen column, viii) a nitrogen-rich gas is drawn from the top of the medium-pressure column and is sent to the intermediate reboiler of the low-pressure column and the condensed gas is sent to the top of the medium-pressure column, and ix) a nitrogen-rich gas or air is sent to the vessel reboiler of the low-pressure column and the liquid that condenses therein is sent to the medium-pressure column characterised in that vessel liquid is withdrawn from the pure oxygen column as a product and in that boosted air at the second pressure is sent to the vaporiser in order to vaporise the first flow of oxygen-rich liquid.

According to other optional aspects of the invention:

the first flow of oxygen-rich liquid is pressurised upstream of the vaporiser.

the first flow of oxygen-rich liquid and the second flow of oxygen-rich liquid have the same purity.

the boosted air at the second pressure is divided into two portions, a first portion of boosted air at the second pressure is sent to the vessel reboiler of the pure oxygen column and a second portion of boosted air at the second pressure is sent to the vaporiser.

air at the first pressure is sent to the vessel reboiler of the low-pressure column in order to heat same.

all of the air is divided into a flow at the first pressure and a flow at the second pressure upstream of the exchange line.

the first flow of oxygen-rich liquid is less rich in oxygen than the second flow of oxygen-rich liquid.

the first flow of oxygen-rich liquid is partially vaporised in the vaporiser, the liquid formed constituting the second flow of oxygen-rich liquid.

the boosted airflow at the second pressure first heats the vessel reboiler of the pure oxygen column and then the vaporiser.

air at the first pressure is cooled in the exchange line and is sent in gaseous form to the medium-pressure column.

a cryogenic liquid from an auxiliary source is sent to the double column.

The terms "medium pressure" and "low pressure" simply designate that the medium-pressure column operates at a pressure that is higher than the low-pressure column. These terms are common in the art and clear for those skilled in the art.

According to a further object of the invention, an apparatus is provided for separating air by cryogenic distillation comprising a medium-pressure column and a low-pressure column, connected thermally together, with the low-pressure column comprising a vessel reboiler and an intermediate reboiler, and a pure oxygen column, an exchange line, a vaporiser, means for sending purified and then cooled gaseous air at a first pressure from the exchange line to the medium-pressure column, means for sending an oxygen-rich liquid and a nitrogen-rich liquid from the medium-pressure column to the low-pressure column, means for withdrawing a nitrogen-rich gas from the low-pressure column, means for withdrawing an oxygen-rich liquid containing at most 97 mol % oxygen from the vessel of the low-pressure column, means for sending a first flow of oxygen-rich liquid to the vaporiser, a pipe for sending the gaseous oxygen formed to the exchange line, means for sending a second flow of oxygen-rich liquid to the top of the pure oxygen column, having a vessel reboiler, where it is purified in order to form a vessel liquid containing at least 98 mol % oxygen, a booster, a pipe for sending a boosted airflow at a second pressure higher than the first pressure to the vessel reboiler of the pure oxygen column, pipes for withdrawing a nitrogen-rich gas from the top of the medium-pressure column, to send same to the intermediate reboiler of the low-pressure column and to send the condensed gas to the top of the medium-pressure column and pipes for sending a nitrogen-rich gas or air to the vessel reboiler of the low-pressure column and to send the liquid that condenses therein to the medium-pressure column characterised in that it comprises a pipe for withdrawing vessel liquid from the pure oxygen column as a product and means for sending boosted air at the second pressure from the booster to the vaporiser.

According to further optional objects of the invention, it is envisaged that the apparatus comprises:

a pipe for sending a liquid from the vaporiser to the top of the pure oxygen column and/or a pipe for sending a vessel liquid from the low-pressure column to the top of the pure oxygen column means for sending boosted air from the booster to the vaporiser are connected to the vessel reboiler of the pure oxygen column in such a way that the air intended for the vaporiser passes through the vessel reboiler of the pure oxygen column.

the means for sending a second flow of oxygen-rich liquid to the top of the pure oxygen column are comprised by the pipe for sending a vessel liquid from the low-pressure column to the top of the pure oxygen column.

means for dividing the boosted air at the second pressure into two portions, the means for sending boosted air at the second pressure from the booster to the vaporiser and the pipe for sending a boosted airflow at the second pressure to the vessel reboiler of the pure oxygen column being connected in such a way that a portion of the boosted air is sent to the vessel reboiler of the pure oxygen column and another portion of boosted air is sent to the vaporiser.

The vaporiser is not part of a distillation or stripping column.

According to a further object of the invention, a method is provided for separating air by cryogenic distillation in a separation unit comprising a medium-pressure column and a low-pressure column, connected thermally together, with the low-pressure column comprising a vessel reboiler and an intermediate reboiler and a pure oxygen column wherein i) purified then cooled air at a first pressure is sent in an exchange line to the medium-pressure column, ii) an oxygen-rich liquid and a nitrogen-rich liquid is sent from the medium-pressure column to the low-pressure column, iii) a nitrogen-rich gas is withdrawn from the low-pressure column, iv) an oxygen-rich liquid containing at most 97 mol % oxygen is withdrawn from the vessel of the low-pressure column, v) a first flow of oxygen-rich liquid is sent to a vaporiser and the gaseous oxygen formed is sent to the exchange line, vi) a second flow of oxygen-rich liquid is sent to the top of the pure oxygen column, having a vessel reboiler, where it is purified in order to form a vessel liquid containing at least 98 mol %, vii) a boosted airflow at a second pressure higher than the first pressure is sent to the vessel reboiler of the pure oxygen column, viii) a nitrogen-rich gas is withdrawn from the top of the medium-pressure column and is sent to the intermediate reboiler of the low-pressure column and the condensed gas is sent to the top of the medium-pressure column, and ix) a nitrogen-rich gas or air is sent to the vessel reboiler of the low-pressure column and the liquid that condenses therein is sent to the medium-pressure column characterised in that vessel liquid is withdrawn from the pure oxygen column as a product and in that the first flow of oxygen-rich liquid is less rich in oxygen than the second flow of oxygen-rich liquid.

According to further optional features:

the first flow of oxygen-rich liquid is pressurised upstream of the vaporiser.

a second flow of boosted air at the second pressure is sent to the vaporiser.

the first flow of oxygen-rich liquid is partially vaporised in the vaporiser, with the liquid formed constituting the second flow of oxygen-rich liquid.

the boosted airflow first heats the vessel reboiler of the pure oxygen column and then the vaporiser.

a cryogenic liquid from an auxiliary source is sent to the double column.

the medium-pressure column operates at between 2.5 and 4.5 bar abs.

According to a further object of the invention, an apparatus is provided for separating air by cryogenic distillation comprising a medium-pressure column and a low-pressure column, connected thermally together, with the low-pressure column comprising a vessel reboiler and an intermediate reboiler and a pure oxygen column, an exchange line, a vaporiser, means for sending purified then cooled gaseous air at a first pressure from the exchange line to the medium-pressure column, means for sending an oxygen-rich liquid and a nitrogen-rich liquid from the medium-pressure column to the low-pressure column, means for withdrawing a nitrogen-rich gas from the low-pressure column, means for withdrawing an oxygen-rich liquid containing at most 97 mol % oxygen in the vessel of the low-pressure column, means for sending a first flow of oxygen-rich liquid to the vaporiser, a pipe for sending the gaseous oxygen formed to the exchange line, means for sending a second flow of oxygen-rich liquid to the top of the pure oxygen column, having a vessel reboiler, where it is purified in order to form a vessel liquid containing at least 98 mol % oxygen, a booster, a pipe for sending a boosted airflow at a second pressure higher than the first pressure to the vessel reboiler of the pure oxygen column, pipes for withdrawing a nitrogen-rich gas from the top of the medium-pressure column, in order to send same to the intermediate reboiler of the low-pressure column and for sending the condensed gas to the top of the medium-pressure column and pipes for sending a nitrogen-rich gas or air to the vessel reboiler of the low-pressure column and for sending the liquid that condenses therein to the medium-pressure column characterised in that it comprises a pipe for withdrawing vessel liquid from the pure oxygen column as a product and a pipe for sending a liquid (53) from the vaporiser (51) to the top of the pure oxygen column (49).

The apparatus can also include a pipe for sending a vessel liquid from the low-pressure column to the top of the pure oxygen column.

The means for sending boosted air from the booster to the vaporiser can be connected to the vessel reboiler of the pure oxygen column in such a way that the air intended for the vaporiser passes through the vessel reboiler of the pure oxygen column.

The means for sending a second flow of oxygen-rich liquid to the top of the pure oxygen column can be comprised of the pipe for sending a vessel liquid from the low-pressure column to the top of the pure oxygen column.

The apparatus can include means for dividing the air boosted at the second pressure into two portions, with the means for sending boosted air at the second pressure from the booster to the vaporiser and the pipe for sending a boosted airflow at the second pressure to the vessel reboiler of the pure oxygen column being connected in such a way that a portion of boosted air is sent to the vessel reboiler of the pure oxygen column and another portion of boosted air is sent to the vaporiser.

The apparatus can include means for sending a cryogenic liquid to the low-pressure column from an outside source.

The apparatus can include a pipe for sending the boosted airflow from the vessel reboiler of the pure oxygen column to the vaporiser and a pipe for sending the air from the vaporiser to the medium-pressure column and/or to the low-pressure column.

According to a further alternative, the apparatus comprises a pipe for sending the boosted airflow from the vessel reboiler of the pure oxygen column directly to the medium-pressure column and/or to the low-pressure column.

The main innovative feature of the invention presented herein is that the reboiling of the pure oxygen column is carried out by a fraction of the gaseous airflow exiting the main exchange line, compressed by a booster at the pressure required for the vaporisation of oxygen in the vaporiser (HP air). This fraction of HP air is condensed partially or entirely in the condenser of the pure oxygen column.

According to an alternative, the partially condensed boosted airflow, possibly after having separated the condensed portion (which is then sent to the MP column), is then sent to the product vaporiser where it fully completes condensation. The partial condensation of the boosted air makes it possible, with a practically nominal flow of production of the GOX and the same pressure, to operate the vaporiser with a pure column vessel, and subsequently that of the product vaporiser. The reboiling of the pure liquid oxygen column is therefore free in relation to the energy required to vaporise the production.

The pressure of this airflow is higher than the pressure of the MP column (typically about 4.5 bar abs. compared to 3.2 bar abs.).

A portion of the impure liquid in the product vaporiser is taken (at the same level and instead of the deconcentration bleed of the vaporiser) and sent into the pure liquid oxygen column which is a column to be distilled substantially at the same pressure as the product vaporiser.

The impure gaseous reflux coming from the pure oxygen column is mixed with the gaseous flux coming from the product vaporiser, with the two fluxes constituting the normal flow of production of the impure GOX.

The pure liquid is taken from the vessel of the pure oxygen column. It is also used as a deconcentration bleed for the entire apparatus.

The supply of frigories can be provided by an independent liquefier, for example by the production of liquid nitrogen, using pure nitrogen (coming from a minaret), which would then be added in liquid form in the apparatus. If there is no production of liquid pure nitrogen, it can be envisaged to liquefy residual nitrogen in an independent liquefier.

If the production of pure liquid is low, it can also be envisaged to have a cooling system incorporated into the ASU.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

The invention shall be described in more detail by referring to the figures, which show methods for separating air according to the invention.

Figure 1:
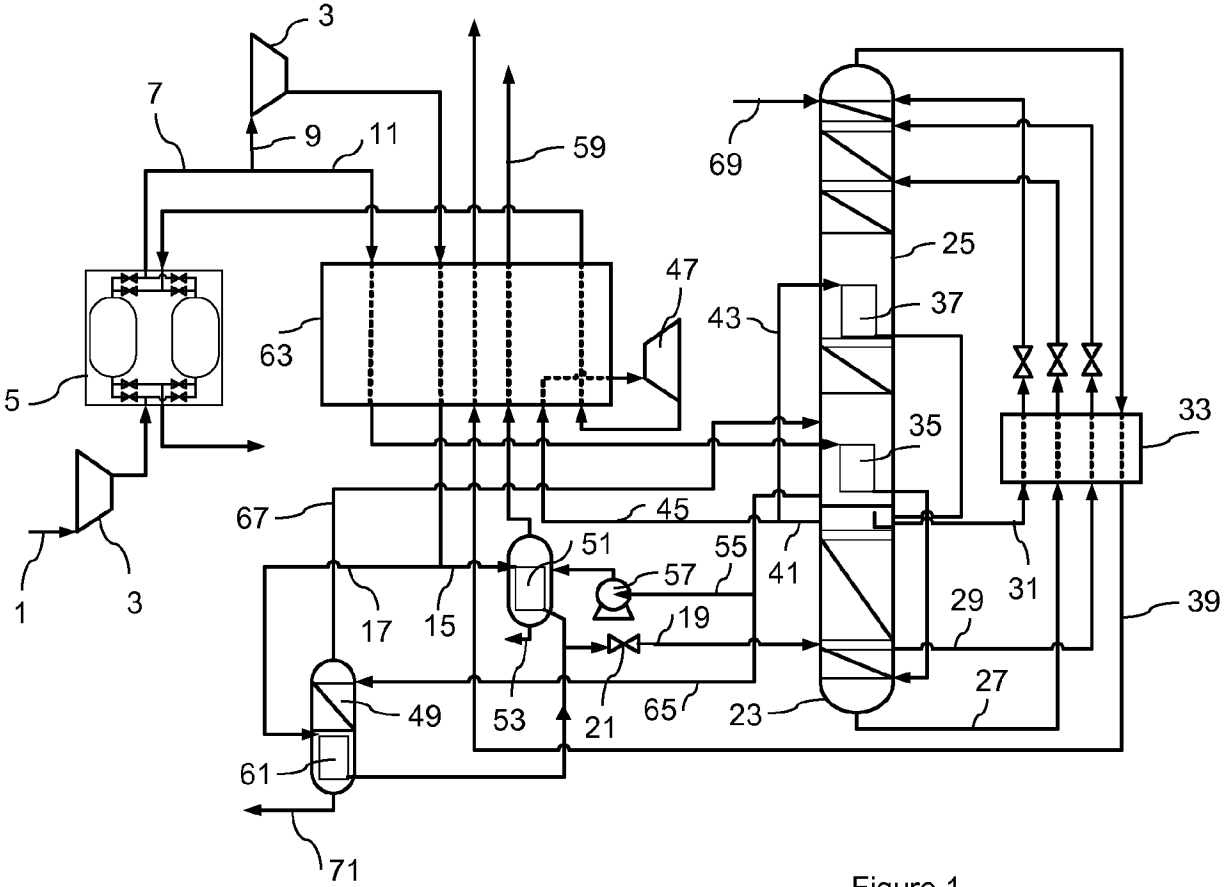
FIG. 1 shows an embodiment of the invention.
Figure 1A:
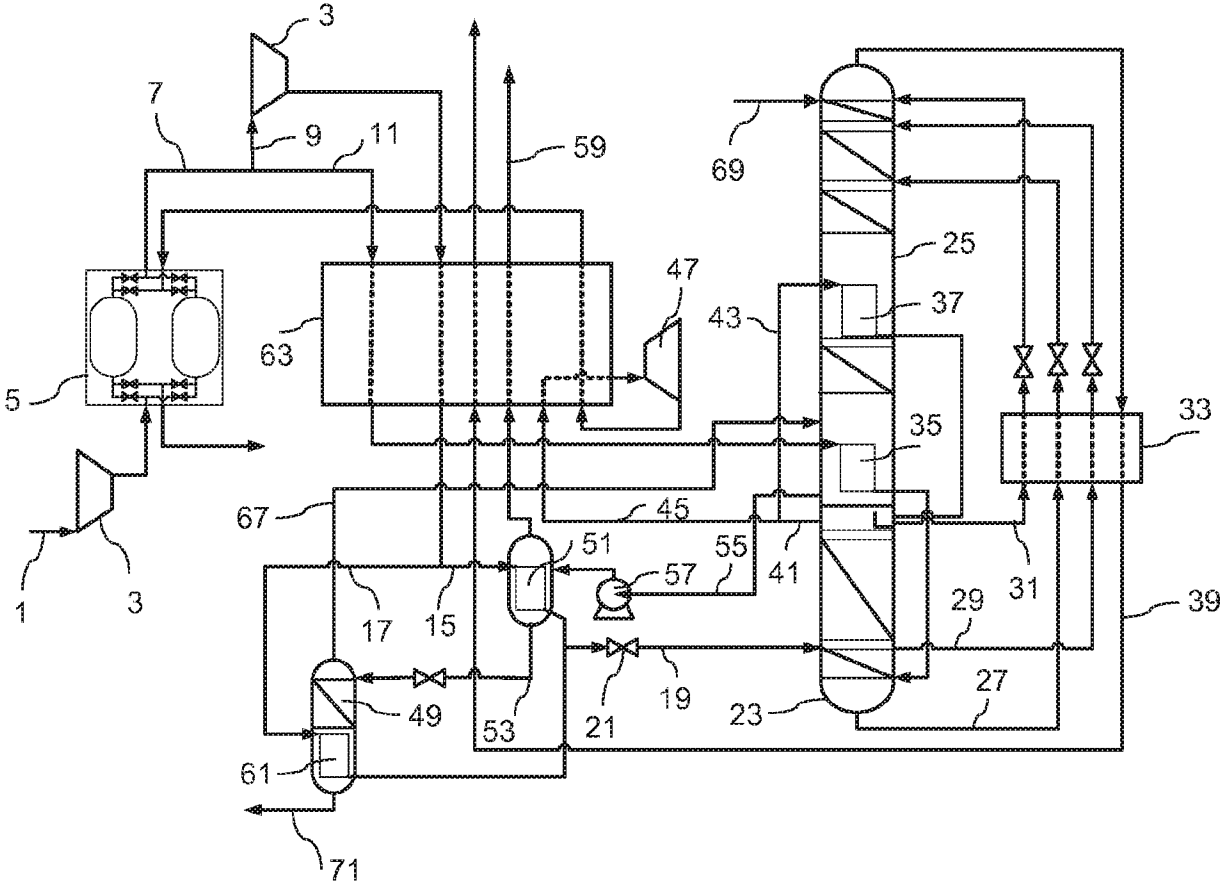

In FIG. 1, the air is separated in an ASU comprising a double column for separating air, comprising a medium-pressure column 23 and a low-pressure column 25. Frigories for the separation are provided via the expansion of medium-pressure nitrogen in a turbine 47. The apparatus comprises a column of pure liquid oxygen 49, a pump 57, a vaporiser 51 and an exchange line 63.

The air 1 is pressurised by a compressor 3 at a pressure between 2.5 and 4.5 bar abs. The air is then purified in a purification unit 5 via adsorption. The purified air 7 is divided into two portions. One portion 9 is boosted in a booster 13 to a pressure between 4 and 20 bar abs and is then cooled in the exchange line 63 until cold. The air 9 is divided into two fractions 15, 17. One fraction 15 is sent to the vaporiser 51 where it is used to partially vaporise liquid oxygen comprising at most 97 mol % oxygen, in order to produce gaseous oxygen 59 which is heated in the exchange line 63. This gas 59 is sent to an oxycombustion unit. An oxygen-rich liquid 53 is withdrawn from the vaporiser 51 as a purge. The air is condensed. The other fraction of the air 17 is sent to the vessel reboiler 61 of the pure oxygen column 49. This column comprises the vessel reboiler and means for exchanging heat and material above this reboiler. Liquid oxygen 65 comprising at most 97 mol % oxygen is sent to the top of the column 49 and is enriched in order to form the liquid product 71 withdrawn from the vessel and containing at least 98 mol % oxygen. The gaseous oxygen from the top of the column 49 is sent to the vessel of the low-pressure column 25. The condensed air 17 is mixed with the condensed air coming from the vaporiser 51 and, after expansion in a valve 21, is sent to the MP column 23, which operates at between 2.5 and 4.5 bar abs.

Another portion 11 of the air is cooled in the exchange line 63, is sent to the vessel reboiler 35 of the LP column 25, is condensed therein at least partially and is sent to the vessel of the MP column 23, below the inlet of liquid air 19.

Oxygen-rich liquid 27 is withdrawn from the vessel of the MP column 23, cooled in the sub-cooler 33, expanded and sent to the LP column 25. Liquid 29 is withdrawn from the MP column 23, cooled in the sub-cooler 33, expanded and sent to the LP column 25. Nitrogen-rich liquid 31 is withdrawn from the top of the MP column 23, cooled in the sub-cooler 33, expanded and sent to the top of the LP column 25.

Low-pressure nitrogen 39 is withdrawn from the top of the LP column, heated in the sub-cooler 33 and heated in the exchange line 63.

Medium-pressure nitrogen 41 is divided into two in order to form a portion 43 and a portion 45. The portion 43 is used to heat the intermediate reboiler 37 of the low-pressure column 25. The portion 45 is heated in the exchange line 63, is expanded in the turbine 47 and is sent back to the exchange line 63. Liquid oxygen is withdrawn from the vessel of the LP column and divided into two. A portion 55 is pressurised in the pump 57 upstream of the vaporiser 51 and the rest 65 is sent to the top of the pure oxygen column 49 without having been pressurised. The top of the pure oxygen column 49 is therefore at the same pressure as the vessel of the low-pressure column 25. All or a portion of the purge liquid 53 can also supply the top of the column 49.

A flow of cryogenic liquid 69, for example liquid nitrogen, is sent to the top of the LP column in order to keep the method cooled.

The method in FIG. 1 a differs from that of FIG. 1 in that the column 49 is supplied at the top exclusively by the purge 53 of the vaporiser 51, following an expansion step in a valve. The vessel reboiler 61 of the column 49 is still heated by the boosted air 17, with the air condensed being mixed with the boosted air 15 which was used to heat the vaporiser 51. It is also possible to supply the column with purge liquid 53 and liquid oxygen 65 coming from the vessel of the low-pressure column 25.

Figure 2:
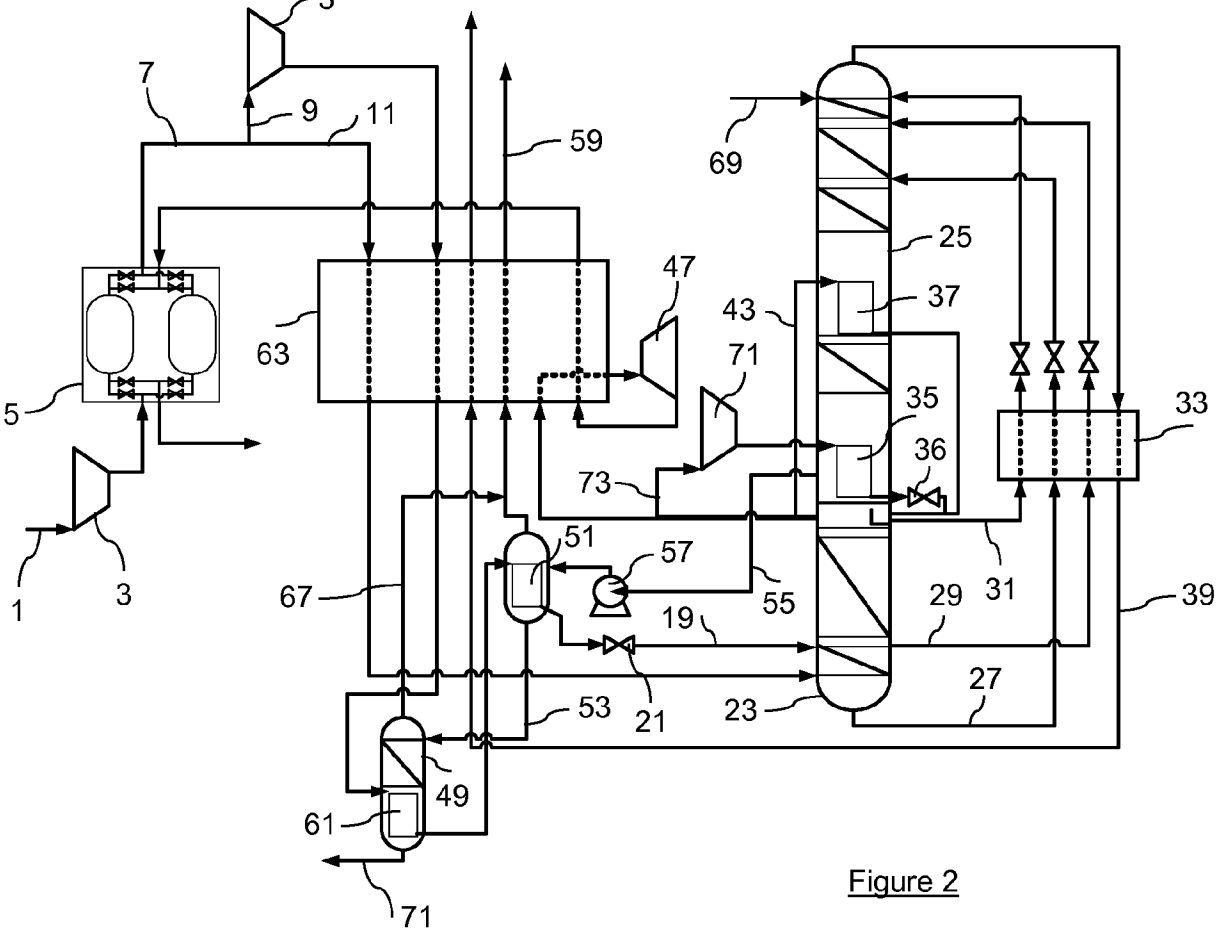
FIG. 2 shows an embodiment of the invention.

The method of FIG. 2 differs from that of FIG. 1 in that the airflow 9 is first sent to the vessel vaporiser 61 of the pure oxygen column 49 and then to the vaporiser 51 where it is condensed. The air formed is expanded in the valve 21 and sent to the medium-pressure column 23. The fraction of air 11 is cooled in the exchange line 11 and is sent to the vessel of the medium-pressure column 23 without having been expanded or compressed downstream of the compressor 3.

The intermediate reboiler 37 is always heated by medium-pressure nitrogen 43 but another portion of the medium-pressure nitrogen 73 is compressed in a cold booster 71 using a cryogenic temperature and sent to the vessel reboiler 35. The condensed nitrogen is expanded in a valve 36 and sent to the top of the MP column 23. The vessel oxygen 55 of the low-pressure column is entirely pressurised in the pump 57 sent to the vaporiser 51 where it is partially vaporised. The vaporised gas constitutes the gaseous oxygen product 59 containing less than 97 mol % oxygen. The non-vaporised liquid 53 supplies the top of the column 49. The gaseous oxygen 67 from the top of the column 49 is mixed with the gaseous oxygen 59. The liquid oxygen 71 constitutes the liquid product. In this case, the pure oxygen column 49 does not operate at the same pressure as the LP column 25.

The method in FIG. 1 or 1 a can use nitrogen to heat the vessel reboiler 35 and the method in FIG. 2 can use air to heat the vessel reboiler 35.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A method for separating air by cryogenic distillation in a separation unit comprising a medium-pressure column and a low-pressure column, connected thermally together, with the low-pressure column comprising a vessel reboiler and an intermediate reboiler, and a pure oxygen column, the method comprising the steps of:

i) introducing a purified and cooled gaseous air at a first pressure from an exchange line to the medium-pressure column;

ii) sending an oxygen-rich liquid and a nitrogen-rich liquid from the medium-pressure column to the low-pressure column;

iii) withdrawing a nitrogen-rich gas from the low-pressure column;

iv) withdrawing an oxygen-rich liquid containing at most 97 mol % oxygen from the vessel reboiler of the low-pressure column;

v) sending a first flow of oxygen-rich liquid to a vaporizer and sending the gaseous oxygen formed to the exchange line;

vi) sending a second flow of oxygen-rich liquid to the top of the pure oxygen column, the pure oxygen column having a pure oxygen reboiler, wherein the second flow of oxygen-rich liquid is purified in order to form a vessel liquid containing at least 98 mol % oxygen;

vii) sending a boosted airflow at a second pressure, higher than the first pressure, to the vessel reboiler of the pure oxygen column;

viii) withdrawing a nitrogen-rich gas from the top of the medium-pressure column and sending the nitrogen-rich gas to the intermediate reboiler of the low-pressure column, and sending the condensed gas to the top of the medium-pressure column; and ix) sending a nitrogen-rich gas or air to the vessel reboiler of the low-pressure column and sending the liquid that condenses therein to the medium-pressure column, x) withdrawing an oxygen-rich top gas from the pure oxygen column and introducing said oxygen-rich top gas to the low-pressure column or to the exchange line for warming, wherein the vessel liquid is withdrawn from the pure oxygen column as a product and boosted air at the second pressure is sent to the vaporizer in order to vaporize the first flow of oxygen-rich liquid, wherein the boosted air at the second pressure is divided into two portions, a first portion of boosted air at the second pressure is sent to the vessel reboiler of the pure oxygen column and a second portion of boosted air at the second pressure is sent to the vaporizer, wherein the first flow of oxygen-rich liquid is partially vaporized in the vaporizer, with the liquid formed constituting the second flow of oxygen-rich liquid, wherein the first flow of oxygen-rich liquid is less rich in oxygen than the second flow of oxygen-rich liquid, wherein the first flow of oxygen-rich liquid is pressurised upstream of the vaporizer.

2. The method as claimed in claim 1, wherein the boosted air flow is at a pressure of about 4.5 bara.

3. The method as claimed in claim 1, wherein the bubble point of the boosted air flow has a bubble point higher than an equilibrium temperature of the vessel liquid from the pure oxygen column.

4. The method as claimed in claim 1, wherein the boosted air flow is at a temperature that is 2° C. to 3° C. warmer than the second flow of oxygen-rich liquid in the pure oxygen reboiler.

5. The method as claimed in claim 1, wherein the pure oxygen column is at a pressure that is equal to the pressure of the low pressure column.

6. The method as claimed in claim 1, wherein a cryogenic liquid from an auxiliary source is sent to the double column.

* * * * *